US012369686B2

(12) United States Patent
De Wilde et al.

(10) Patent No.: US 12,369,686 B2
(45) Date of Patent: Jul. 29, 2025

(54) TRIPOD RUNNING SHOES

(71) Applicants: Jim De Wilde, Oldsmar, FL (US); Tom De Wilde, Oldsmar, FL (US)

(72) Inventors: Jim De Wilde, Oldsmar, FL (US); Tom De Wilde, Oldsmar, FL (US)

( * ) Notice: Subject to any disclaimer, the term of this patent is extended or adjusted under 35 U.S.C. 154(b) by 249 days.

(21) Appl. No.: 17/898,361

(22) Filed: Aug. 29, 2022

(65) Prior Publication Data

US 2023/0062125 A1 Mar. 2, 2023

Related U.S. Application Data

(60) Provisional application No. 63/237,916, filed on Aug. 27, 2021.

(51) Int. Cl.
*A43B 13/18* (2006.01)
*A43B 5/06* (2022.01)
*A43B 13/37* (2006.01)

(52) U.S. Cl.
CPC ..... *A43B 13/188* (2013.01); *A43B 5/06* (2013.01); *A43B 13/37* (2013.01)

(58) Field of Classification Search
None
See application file for complete search history.

(56) References Cited

U.S. PATENT DOCUMENTS 4,358,902 A * 11/1982 Cole ..... A43B 13/206 36/35 B
5,179,792 A * 1/1993 Brantingham ..... A43B 13/203 36/71
5,195,257 A * 3/1993 Holcomb ..... A43B 7/1425 36/71
5,771,606 A * 6/1998 Litchfield ..... A43B 13/203 36/71
6,085,444 A * 7/2000 Cho ..... A43B 7/06 36/3 R
7,219,447 B2 * 5/2007 LeVert ..... A43B 7/1425 36/27
11,096,446 B2 * 8/2021 Brandt ..... B29C 66/438
11,234,485 B2 * 2/2022 Henrichot ..... A43B 3/34
11,497,273 B2 * 11/2022 Adametz ..... A43B 13/182
2002/0133976 A1 * 9/2002 Crutcher ..... A43B 13/182 36/27
2005/0241184 A1 * 11/2005 LeVert ..... A43B 13/182 36/27
2008/0209762 A1 * 9/2008 Krafsur ..... A43B 7/1425 36/35 R
2009/0107006 A1 * 4/2009 Ahn ..... A43B 13/182 36/38
2010/0199517 A1 * 8/2010 LeVert ..... A43B 13/182 36/27
2013/0263471 A1 * 10/2013 Spinks ..... A43B 13/40 36/43

* cited by examiner

*Primary Examiner* — Jila M Mohandesi
(74) *Attorney, Agent, or Firm* — Attentive Law Group; Paul Ratcliffe

(57) ABSTRACT

A running shoe having an improved sole including one or more cushioning elements disposed at or around one or more of the foot's tripod strike points, wherein such cushioning elements may optionally be connected to each other by one or more bridges and the region bounded by the cushioning elements is vertically enlarged to provide added space for various structures of the foot to deform.

16 Claims, 12 Drawing Sheets

TRIPOD RUNNING SHOES

RELATED APPLICATION

This application claims priority to U.S. Provisional Application 63/237,916 filed on Aug. 27, 2021, entitled "Tripod Running Shoes", the entirety of which is incorporated herein.

FIELD OF THE INVENTION

The present invention relates to running shoe soles which help runners of all skill and performance levels to improve their running performance while decreasing the chance of running related injuries.

BACKGROUND OF THE INVENTION

Targeted Absorption or Bounce Creating Elements

During gait, an individual's foot initially contacts the ground at one or more of three points. These points are the heel, the ball of the foot at or around the first metatarsal, and the lateral portion of the forefoot at or near the fifth metatarsal (referred to as the tripod strike points). The tripod strike points are vital in the body's tensegrity system as they initiate the biomechanical flow of elastic energy in and through the foot and legs. In particular, elastic energy is generated in the foot and legs as the foot's dome, plantar fascia, and other ligamentous or bony structures, act as a spring by deforming, or 'coiling', and then reforming, or 'uncoiling'. Thus, improving the ability of the dome, plantar fascia, and/or other gait-related structures, to 'coil' and 'uncoil' enhances the total flow of elastic energy in and through the body's tensegrity system.

Many running shoe manufacturers have developed special sole structures and variations of running shoes with impact absorption or cushioning sections to create stability and bounce and thereby enhance running performance. These sections are formed around the heel and forefoot areas of the shoe, and more typically, around the entire sole, in an attempt to absorb impact and improve performance.

However, current running shoe designs fail to provide a running shoe having a sole that exclusively provides a targeted absorption and/or bounce creating structure of the three tripod strike points and/or a stabilizing structure to the tripod triangle, without having such structures diminish the dome deformation space. Consequently, current running shoe designs suboptimally support, and may even hamper, the body's tensegrity system and a runner's performance.

Therefore, design improvements are needed to overcome these deficiencies and problems while accommodating the evolving needs of runners or users. The designs and various embodiments of the present invention provide such improvements.

SUMMARY OF INVENTION

The present invention overcomes the problems and design deficiencies of current running shoes by providing a running shoe designed to specifically target and support the tripod strike points during a runner's gait. More specifically, the present invention provides a running shoe with a tripod strike point impact absorption and recoil system in the sole of the shoe.

This present invention provides a running shoe, and particularly the sole, insole, in-lay, insert, or any subportion of such structures, of a running shoe that enhances the foot's natural properties to create stability and elastic energy. The potential benefits of the present invention include but are not limited to: (1) increased stability; (2) minimized running related injuries of, among others, the three tripod strike points, the tripod triangle, the plantar fascia ligament, the Achilles tendon, and the cuneiform bones; and (3) faster running through maximized elastic energy and maximized airtime, as well as the relative lightness and sleekness of the running shoes.

The ways in which the present invention assists runners includes, but is not limited to, supporting and/or enhancing the runner's ability to support and increase the flow of elastic energy generated by the striking impact on one or more of the runner's three tripod strike points. During running, the striking impact on the tripod strike points, which can be viewed as the pillars of the foot's dome, causes the dome to travel downward and expand or elongate. This dome movement builds up elastic energy, similar to the coiling of a spring. Soon after, the dome and other parts of the coiling mechanism will return to their natural positions, thereby uncoiling the spring and releasing the built-up elastic energy into the tensegrity system of the runner's legs and body.

The present invention supports and enhances the flow of this elastic energy by providing targeted support for the three tripod strike points, while omitting additional absorption material regions, such as, for example, at or within the tripod triangle and/or the inner tripod. The absence of absorption material under the tripod triangle provides additional vertical space for the dome and plantar fascia to deform, thereby increasing magnitude of 'coiling' and 'uncoiling' and likewise increasing the elastic power flow.

The present invention provides increased structural designs to enhance the three tripod strike points. Such structural designs include: (1) specific design elements at the three tripod strike points; (2) use of a stabilizing structure in the shape of a 'tripod triangle' design; (3) use of a 'tripod V-shape' design; and/or (4) use of a 'tripod Y-shape' design. Importantly, the targeted absorption or bounce creating elements help to extend the size or length of the three tripod points (heel, first metatarsal, fifth metatarsal), as well as the power of the tripod and dome. This extension or size expansion of the tripod points by the targeted absorption or bounce creating elements keeps the tripod points at an elevated height (as compared to the foot on a flat surface) which provides more vertical dome deformation space as well as extends the distance between the tripod points due to the load and flattening of the foot under load. This extension of size expansion increases the dome deformation space which results in increased potential build-up of elastic energy from a larger or increased coiling and uncoiling of the foot's dome.

In addition, the present invention provides an article of footwear comprising an upper, and a sole having a triangular shaped sole insert. The triangular shaped sole insert includes a heel cushioning element, a first metatarsal cushioning element, and a fifth metatarsal cushioning element. The sole insert further includes a first bridge connecting the heel cushioning element to the first metatarsal cushioning element, a second bridge connecting the heel cushioning element to the fifth metatarsal cushioning element, and a third bridge connecting the first metatarsal cushioning element to the fifth metatarsal cushioning element. The heel cushioning element, the first metatarsal cushioning element, and the fifth metatarsal cushioning element may be made from a polymer material and have a spring like shape or design or a concave cup like shape or design. The first bridge, second bridge, and third bridge may have a concave or crescent shape with an apex, may be flat, or have a downward concave shape. The cushioning elements with the bridges forms a generally triangular shape which also creates a triangular void in the center of the tripod triangle.

Further, the present invention provides a sole insert structure for an article of footwear, where the sole insert structure includes a heel cushioning element, a first metatarsal cushioning element, and a fifth metatarsal cushioning element. The sole insert structure further includes a first bridge connecting the heel cushioning element to the first metatarsal cushioning element, a second bridge connecting the heel cushioning element to the fifth metatarsal cushioning element, and a third bridge connecting the first metatarsal cushioning element to the fifth metatarsal cushioning element. The heel cushioning element, the first metatarsal cushioning element, and the fifth metatarsal cushioning element may be made from a polymer material and have a spring like shape or design or a concave cup like shape or design. The first bridge, second bridge, and third bridge may have a concave or crescent shape with an apex, may be flat, or have a downward concave shape. The cushioning elements with the bridges forms a generally triangular shape which also creates a triangular void in the center of the tripod triangle.

The various aspects of the present invention will be described in more detail below in conjunction with the drawings.

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF EXEMPLARY EMBODIMENTS

Hereinafter, aspects of the present invention in accordance with various embodiments of the invention will be described. As used herein, any term in the singular may be interpreted to be in the plural, and alternatively, any term in the plural may be interpreted to be in the singular. It is appreciated that features of one embodiment as described herein may be used in conjunction with other embodiments. The present invention can be more fully understood by reading the following detailed description together with the accompanying drawings, in which like reference indicators are used to designate like elements.

Figure 3A:
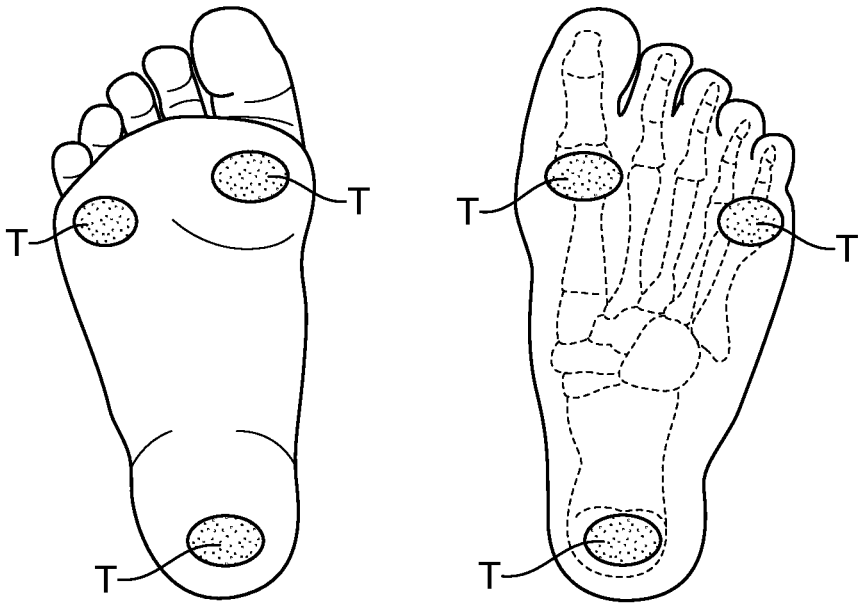
FIG. 3A depicts a bottom view of the foot illustrating the three tripod points.

The present invention provides a running shoe, and particularly, the sole, insole, in-lay, insert, or any subportion of such structures, of a running shoe, that enhances the foot's natural properties to create stability and elastic energy through use of a triangular connection between the three tripod points on the foot (see FIG. 3A). These three tripod points on the foot include the heel, the ball of the foot at or around the first metatarsal, and the lateral portion of the forefoot at or near the fifth metatarsal. As briefly mentioned above, the foot's functions that the present invention supports and/or enhances include, but are not limited to: (1) creating stability through dissipating landing impact energy; (2) turning landing impact energy into elastic energy through the foot's three tripod strike points and/or the tripod triangle; and (3) guiding the foot to an optimal push off from the 'inner tripod' of the foot (see FIG. 3B).

FIGS. 1-3B depict various views of the human foot and the forces exerted by the body and the ground during a stride cycle. The human foot creates stability and landing impact dissipation and turns landing impact energy into elastic energy and 'airtime' (time spent not touching the ground), in large part through the three tripod strike points and the tripod triangle, which in turn are related to the strength and flexibility of the Achilles heel tendon, the plantar fascia ligament and the foot's dome structure (see FIG. 1-2C). These physical structures and their corresponding response to a step or stride will be discussed in more detail below.

Figure 1:
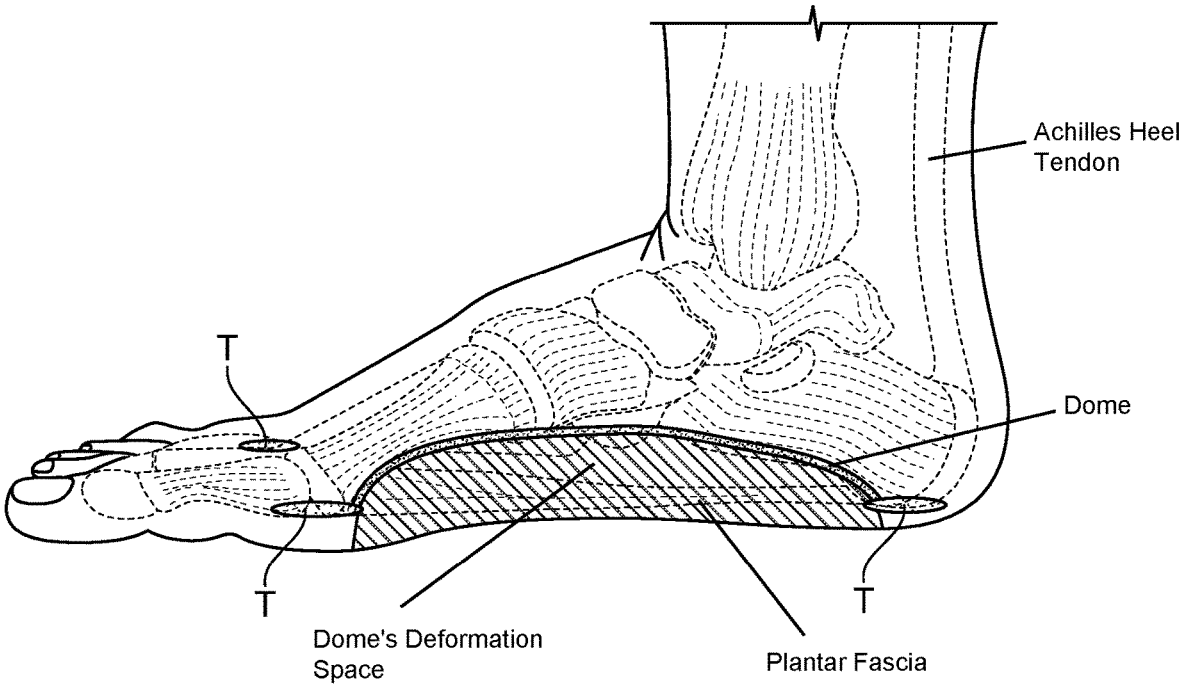
FIG. 1 is a side elevation view of the foot depicting various structures that facilitate movement.
Figure 2A:
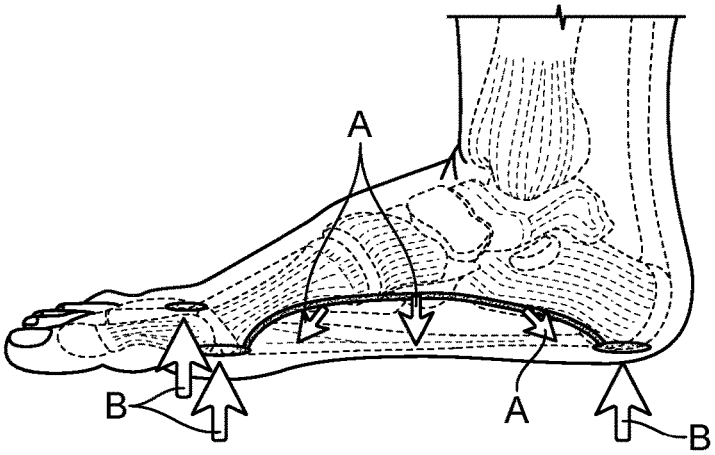
FIG. 2A depicts a side elevation view of the foot during the initial moment of a foot's ground strike.
Figure 2B:
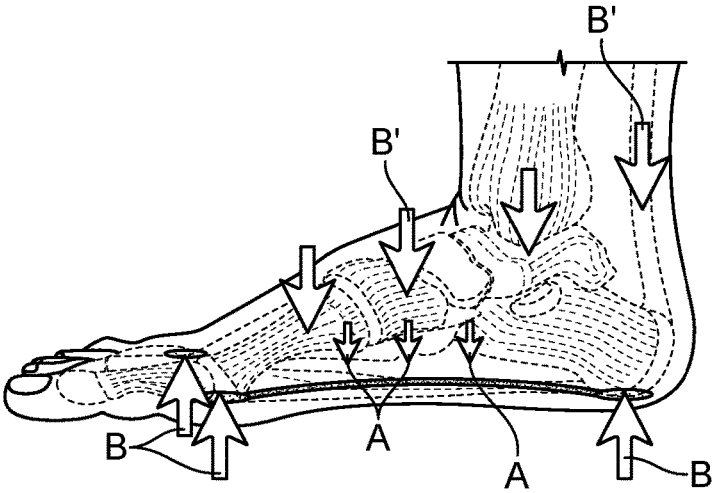
FIG. 2B depicts a side elevation view of the foot during transition from ground strike to beginning the next stride.
Figure 2C:
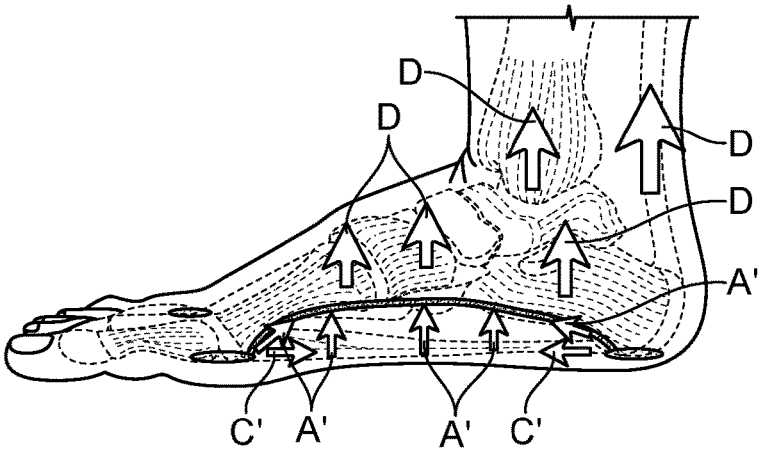
FIG. 2C depicts a side elevation view of the foot after the foot has completed the transition stage and begins to push off the ground.

FIGS. 2A-2C depict a step or stride cycle. FIG. 2A depicts an example of a foot initiating ground strike during the landing stage of a stride, where arrows A illustrate the deformation of the foot's dome (see FIG. 1) as a result of the initiation of load on the foot due to the runner's body weight and arrows B denote force exerted on the foot by the ground. FIG. 2B depicts the foot as the runner completes the ground strike during the transition stage of a stride prior to the runner pushing off with the foot to begin the next stride. During this stage, the foot experiences maximal load transmitted to the foot by the runner's weight. This is depicted by arrows B' and leads to additional deformation of the foot's dome (see arrows A, FIG. 2B) and an elongation of the runner's plantar fascia, denoted by arrows C. As will be understood to those skilled in the art, the dome and plantar fascia tend to act as springs, where elongation of the plantar fascia and the flattening deformation of the dome, and any resultant bony translation, gathers potential energy (i.e., coiling of the spring) and contraction of the plantar fascia and reformation of the dome and other bony structures releases the gathered energy (i.e., uncoiling of the spring). The runner then utilizes this energy to push off the ground to begin the next stride, which is illustrated in FIG. 2C. As depicted in FIG. 2C, the foot, aided by contraction of the plantar fascia (see arrows C') and the consequent force transmitted to the foot (see arrows D), pushes off the ground to complete the stride cycle and to begin a mirrored stride cycle in the runner's other foot. The foot's dome, along with the plantar fascia, return to their natural conformations (see arrows A'), which provides additional bounce and performance to the runner. The runner's other foot then undergoes such stride cycle.

Figure 3B:
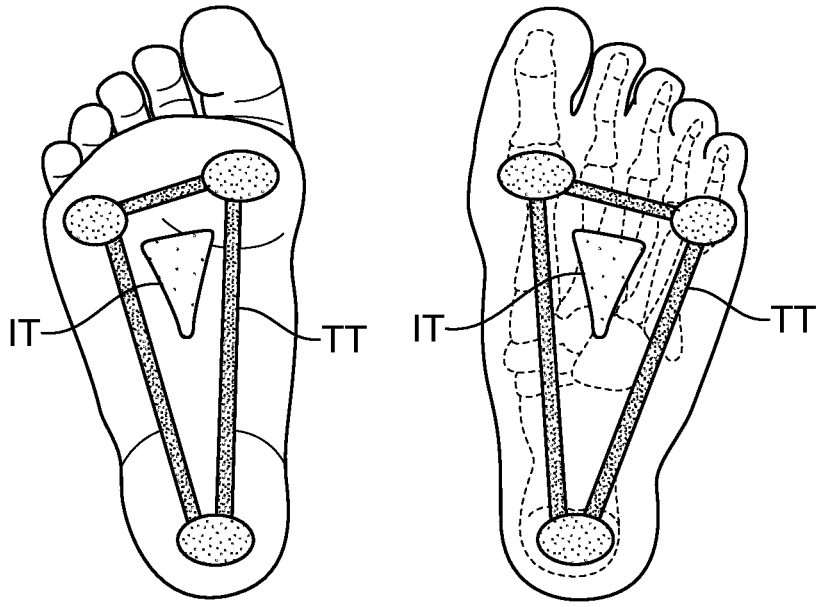
FIG. 3B depicts a bottom view of the foot illustrating the tripod triangle with the inner tripod.

FIGS. 3A and 3B illustrate the three tripod strike points and the tripod triangle described above. The three tripod points, which are located at or around the heel of the foot, the ball of the foot adjacent the first metatarsal, and the lateral portion of the forefoot adjacent the fifth metatarsal, are illustrated by shading and denoted by the reference letter T. Taken together, the tripod points T form a generally triangular shape, which is referred to as the tripod triangle. FIG. 3B depicts the tripod triangle, which is highlighted by thicker shaded lines identified by the reference letters TT. Within the tripod triangle TT is a smaller, generally triangular area that is a preferred push off location for the foot. This area is referred to as the inner tripod and denoted by the reference letters IT.

Figure 4A:
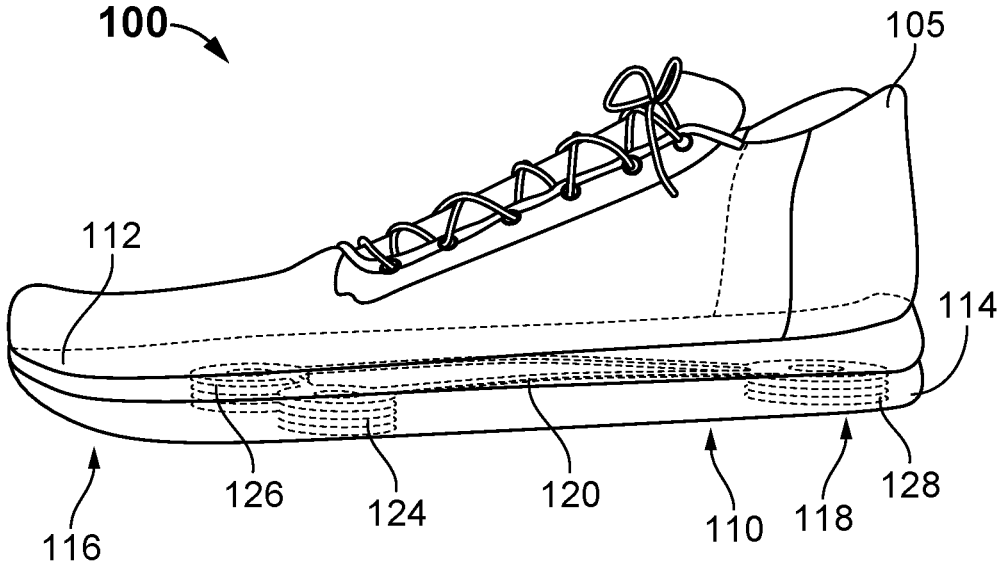
FIG. 4A depicts a side elevation view of a preferred embodiment of the present invention inserted into the sole unit of a shoe.
Figure 4B:
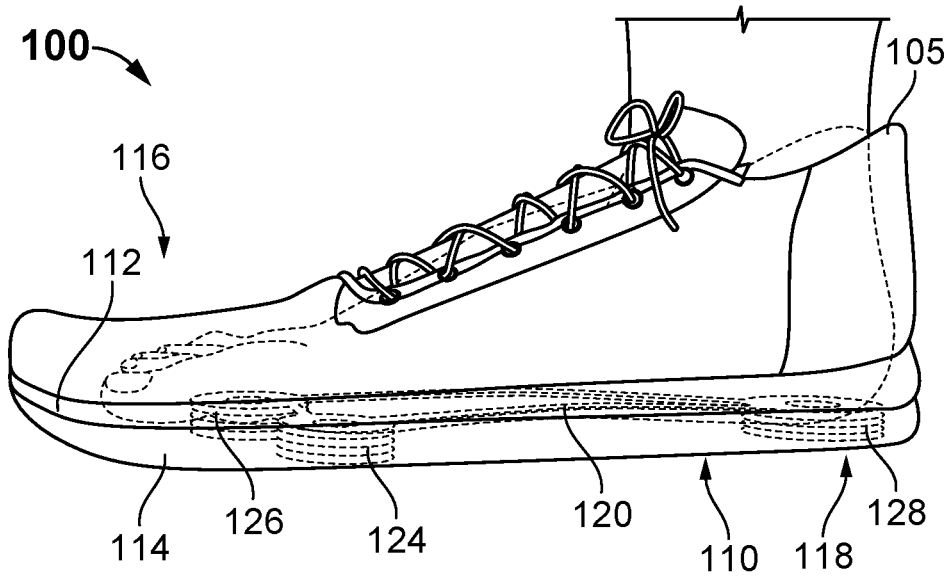
FIG. 4B depicts the embodiment of FIG. 4A with a human foot inserted therein.
Figure 5:
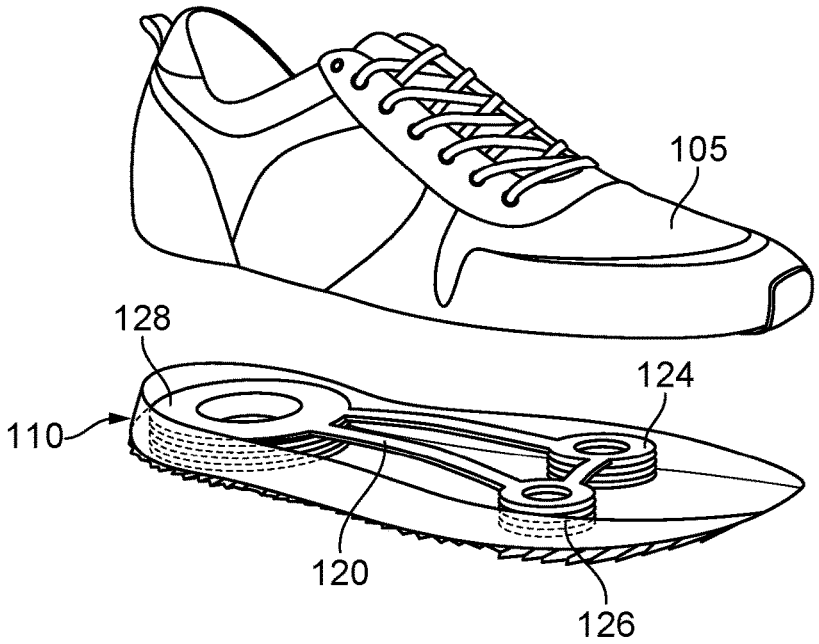
FIG. 5 depicts a perspective view of a preferred embodiment of the present invention with the shoe upper illustrated broken away from the sole unit.

Referring to FIGS. 4A-5, the present invention provides an improved running shoe 100 which includes an upper portion 105, a tripod sole unit 110, a midsole 112, an outsole 114, and a toe portion 116. The tripod sole unit 110 includes the midsole 112 located within, above, or formed as an integral part with the outsole 114. The outsole 114 is configured to make contact with the ground during running or walking and is formed of any suitable material known in the art such as, for instance, a carbon or blown rubber material. The midsole 112 is generally designed to provide cushioning, as well as, increased running performance and is formed of any suitable material known in the art such as, for instance, a polymer foam. As will be described in more detail below, the present invention provides an improvement over conventional running shoes by providing additional structures or modifications within or to the midsole 112 and/or the outsole 114 that increase the 'coiling' and 'uncoiling' space provided to the foot's dome and plantar fascia. The sole unit 110, and thus the midsole 112 and outsole 114, include the toe portion 116 adjacent the distal region of the foot and a heel portion 118 adjacent the proximal region of the foot. The sole unit 110 further includes a stabilizing structure 120 in the shape of a tripod structure.

Figure 6:
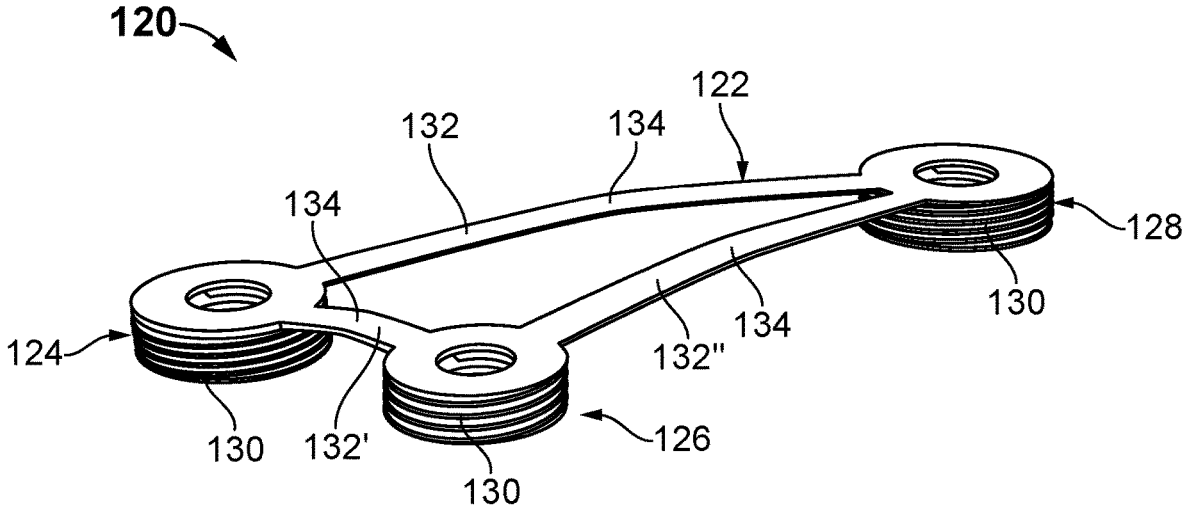
FIG. 6 depicts a left-side perspective view of a spring type of reinforcement element of a preferred embodiment of the present invention.
Figure 7:
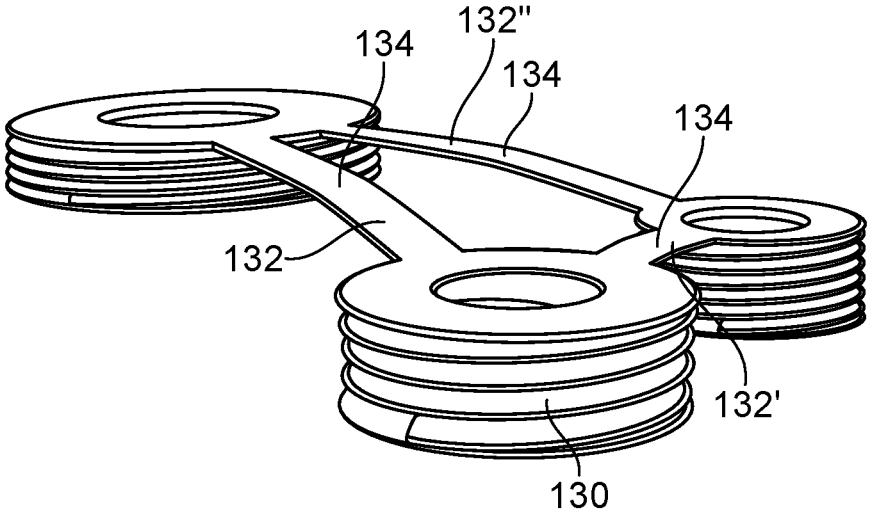
FIG. 7 depicts a right-side perspective view of the spring type of reinforcement element of FIG. 6.
Figure 8:
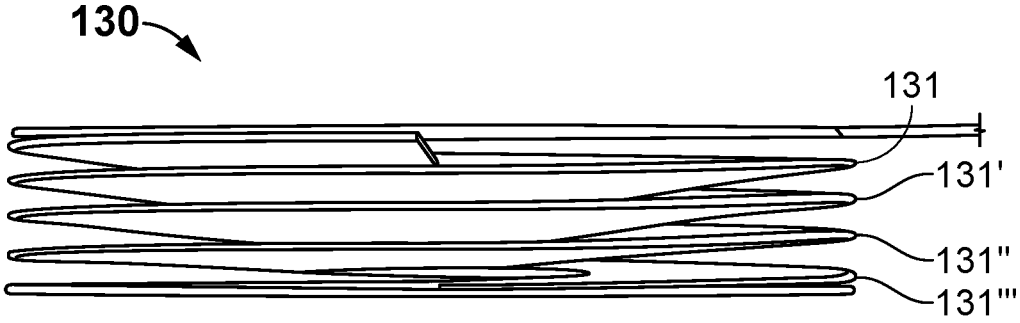
FIG. 8 depicts a side elevation view of one of the spring type of reinforcement elements of FIG. 6.

Referring now to FIGS. 6-8, the tripod structure 120 includes a continuous tripod frame 122 and a first metatarsal support or cushioning element 124 located adjacent the medial aspect of the forefoot (i.e., the ball of the foot), an additional metatarsal support or cushioning element 126 located around the fifth metatarsal and adjacent the lateral aspect of the forefoot (i.e., laterally opposite the ball of the foot), and a heel support or cushioning element 128 located at or about the heel region of the foot. FIG. 6 shows a perspective view of the left foot or left shoe tripod structure 120, whereas FIG. 7 shows a perspective view of the right foot or shoe tripod structure 120. The support elements 124, 126, 128 are generally cylindrical in shape and are configured to elastically deform in a spring-like manner. In an embodiment, the support elements 124, 126, 128 are disks formed as a continuous spiral 130 (see FIG. 8). The continuous spiral 130 is defined by a spring like accordion coil structure having outer edges 131, 131', 131", 131'" and an inner bellow portion.

In an embodiment, the tripod frame 122 extends between and connects the support elements 124, 126, 128 forming a generally triangular shape. The tripod frame 122 includes one or more spring-like bridges that connect the support elements 124, 126, and 128 to each other. Referring to FIGS. 6 and 7, a medial bridge 132 connects the first metatarsal support element 124 with the heel support element 128, a lateral bridge 132' connects the fifth metatarsal support element 126 with the heel element 128, and a forefoot bridge 132" connects the first and fifth metatarsal support elements 124, 126. In an embodiment, the bridges 132, 132', 132" can be inclined on each end so each bridge 132, 132', 132" has or forms an apex 134 at a generally equidistant location between the various support elements 124, 126, 128. However, the apex 134 of each bridge 132, 132', 132" could be placed at a location other than the general midpoint. Still further, the bridges could be implemented without an incline or apex or could be declined forming a low point along each bridge. The bridges 132, 132', 132" enable the tripod structure 120 to act as integral unit such that the coiling or uncoiling of one support element 124, 126, 128 impacts the respective bridge 132, 132', 132" which are in communication with or are connected to the support element 124, 126, 128 under load. This communication or transfer of load impacts the connected bridge 132, 132', 132" which impacts the other support elements 124, 126, 128. This integral unit action helps support the entire foot even in instances where the foot does not land flat. In some embodiments, the bridges act as compression bridges to further distribute the load of impact placed on the foot and to support the perimeter of the tripod triangle. The bridges 132, 132', 132" can act as a spring providing additional elastic support and bounce to the tripod running shoe 100. Moreover, the continuous structure of the tripod frame 122 allows the tripod structure 120 to provide elastic support and bounce to specific regions of the foot as needed by the user. However, the bridges could be designed to provide little to no additional elastic support. The variances in design of the bridges 132, 132', 132" can be optimized to still provide ample space of the natural coil and recoil ability of the dome and fascia of the foot while still providing support and stability to both the foot and the tripod structure 120. In other embodiments, the tripod frame 122 may have a different number of connecting bridges. For example, one embodiment may omit the forefoot bridge 132" from the tripod frame 122, thereby forming a generally V-shaped frame. Other embodiments may provide support elements 124, 126, 128 as separate structures unconnected by any bridges (see FIG. 14, described in more detail, below).

Figure 9A:
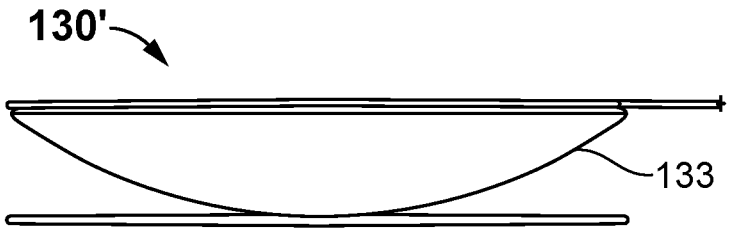
FIG. 9A depicts a side elevation view of an alternative spring type of reinforcement element featuring a concave cushion.
Figure 9B:
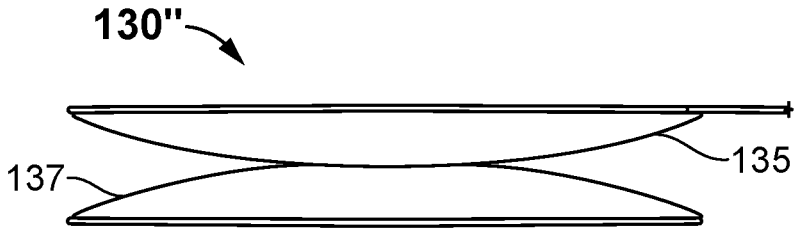
FIG. 9B depicts a side elevation view of a further alternative spring type of reinforcement element featuring two concave cushions.
Figure 9C:
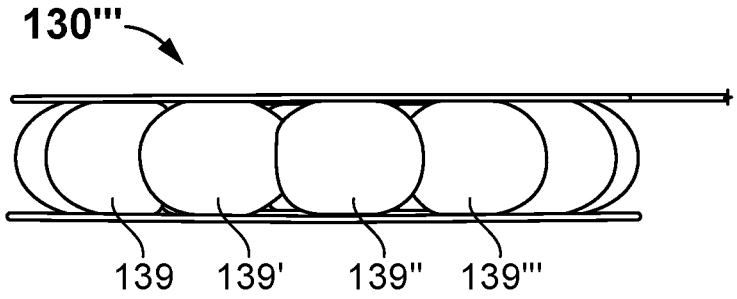
FIG. 9C depicts a side elevation view of a still further alternative spring type of reinforcement element featuring a series of deformable spheres.

FIGS. 9A-9C provide alternative embodiments of support elements 124, 126, 128. In particular, FIG. 9A depicts a cushion support element 130' having a deformable spring-like cushion 133 capable of elastic deformation. In such embodiment, the cushion 133 may provide additional performance to runners with a more lateral or medial gait, which tends to ground strike adjacent the lateral or medial aspects of the foot, respectively.

FIG. 9B depicts a double-cushion support element 133" having an upper cushion 135 and lower cushion 137. In such embodiment, the upper cushion 135 and/or the lower cushion 137 may provide additional performance to runners by providing additional bounce, while also maintaining support for average and medial or lateral gaits.

FIG. 9C depicts an encased sphere support element 133''' having a series of elastically deformable spherical elements, such as spheres 139, 139', 139", 139''', for example. It will be understood that the spheres are located adjacent the perimeter of the support element 130''', which are not shown and/or not labeled. In such embodiment, each of the spheres 139, 139', 139", 139''' are individual units, thus enabling certain spheres to deform to a greater or lesser extent proportional to the load disposition of a particular runner.

Generally, FIGS. 10A-13C provide alternate embodiments of the present invention incorporating tripod triangular support structures that may be formed on, in, and/or through the bottom of the sole. As will be evident to ordinarily skilled artisans, the embodiments depicted in FIGS. 10A-13C illustrate various embodiments of tripod triangle support that provide similar benefits to the runner as the embodiments depicted in FIGS. 4A-9C.

Figure 10A:
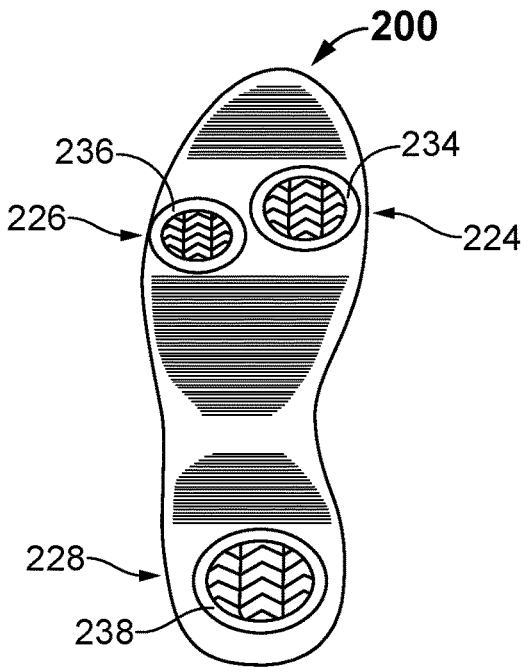
FIG. 10A depicts a bottom view of a shoe according to the present invention having protrusions at the three tripod points.
Figure 10B:
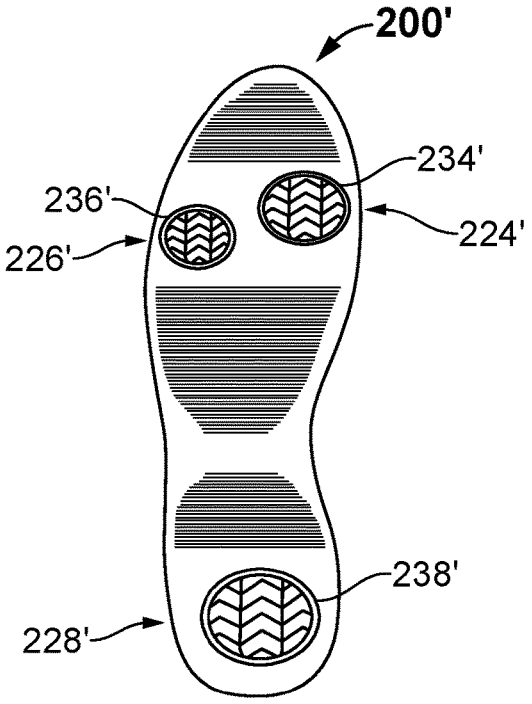
FIG. 10B depicts a bottom view of the shoe having structural fortifications at the three tripod points.
Figure 10C:
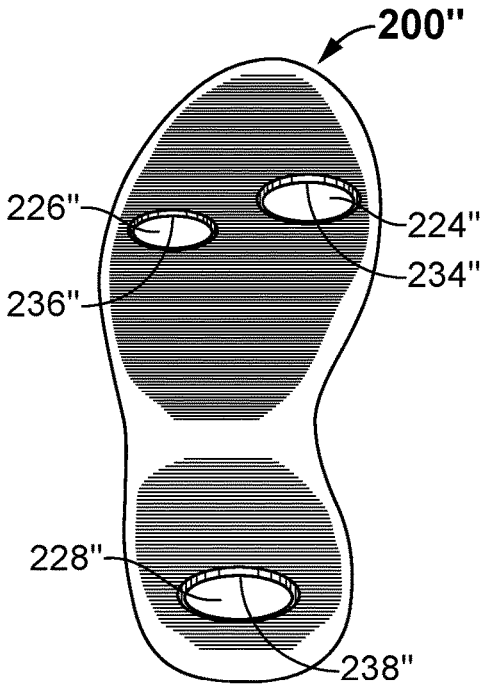
FIG. 10C depicts a bottom view of the shoe with recesses at the three tripod points.

FIGS. 10A-10C incorporate the concept of separate tripod point support elements, where the support elements are disposed adjacent the three tripod strike points. FIG. 10A depicts a shoe 200 having support elements 224, 226, 228 located adjacent the first metatarsal, fifth metatarsal, and heel, respectively, that communicate with the ground during ground strike. The support elements 224, 226, 228 include protrusions 234, 236, 238, respectively, that provide additional stability, support, and bounce to the runner. FIG. 10B depicts a shoe 200' having support elements 224', 226', 228' that include structural fortifications 234', 236', 238', respectively, to provide additional stability, support, and bounce to the runner. FIG. 10C depicts a shoe 200" having recessed support elements 224", 226", 228" defined by perimeters 234", 236", 238", respectively, to provide additional stability, support, and bounce to the runner.

Figure 11A:
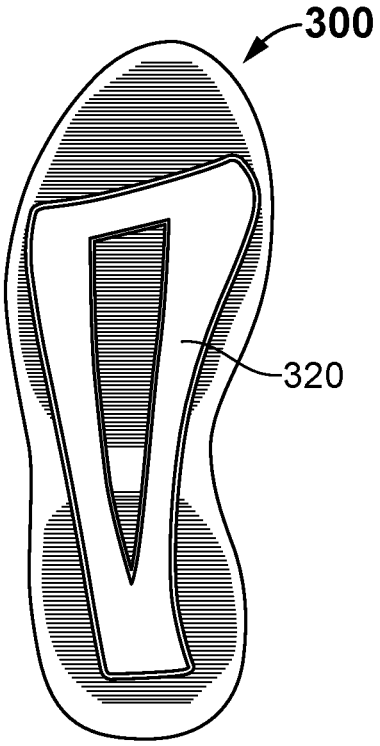
FIG. 11A depicts a bottom view of the shoe having a protruding tripod triangle structure.
Figure 11B:
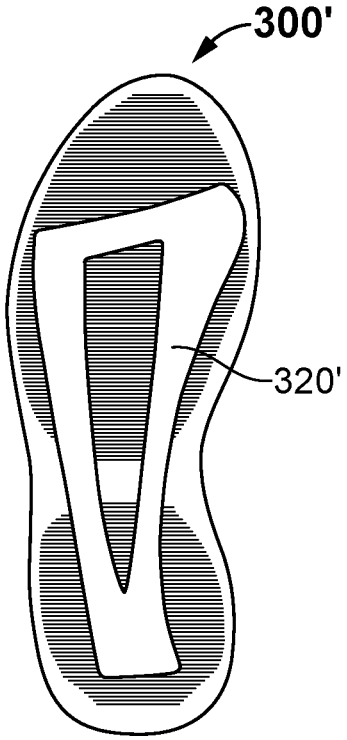
FIG. 11B depicts a bottom view of the shoe with the tripod triangle structure having structural fortifications.

FIGS. 11A and 11B incorporate the concept of continuous tripod triangle support elements formed on, in, and/or through the bottom of the sole of a shoe. FIG. 11A provides a shoe 300 having a protruding continuous tripod triangle support structure 320. FIG. 11B provides an alternative shoe 300' having a fortified continuous tripod triangle support structure 320'.

Figure 12A:
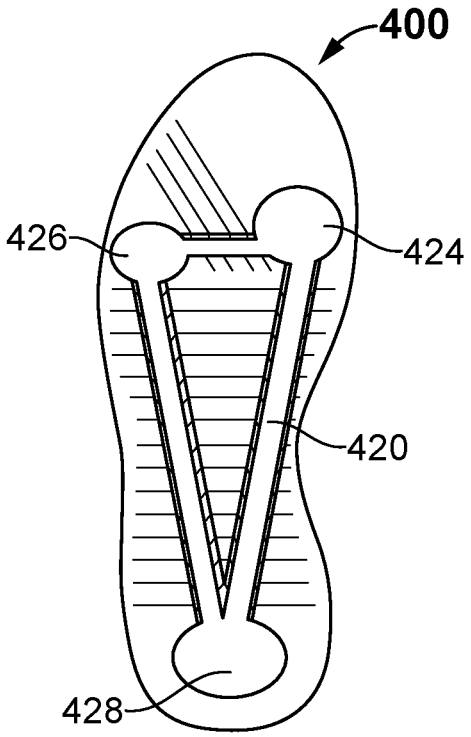
FIG. 12A depicts a bottom view of the shoe with the tripod triangle structure having structural fortifications and with the sides of the tripod triangle hollowed out.
Figure 12B:
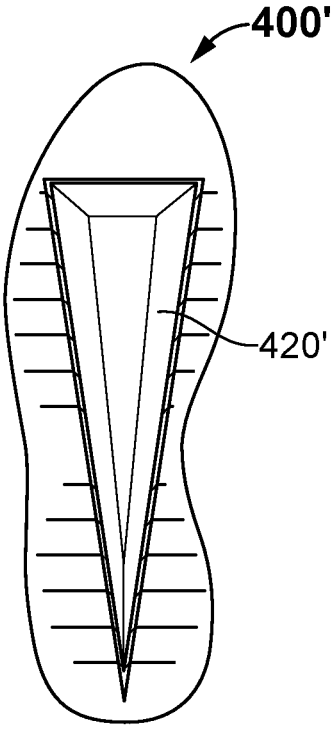
FIG. 12B depicts a bottom view of the shoe with the tripod triangle being hollowed out.

FIGS. 12A and 12B provide shoes incorporating one or more of the foregoing embodiments of tripod triangle support. FIG. 12A depicts a shoe 400 having a recessed continuous tripod triangle support structure 420. The support structure 420 includes structurally fortified recesses 424, 426, 428 adjacent each of the three tripod strike points. FIG. 12B depicts a shoe 400' having a single structurally fortified recessed tripod triangle support structure 420'. The support structure 420' is generally defined by the tripod triangle.

Figure 13A:
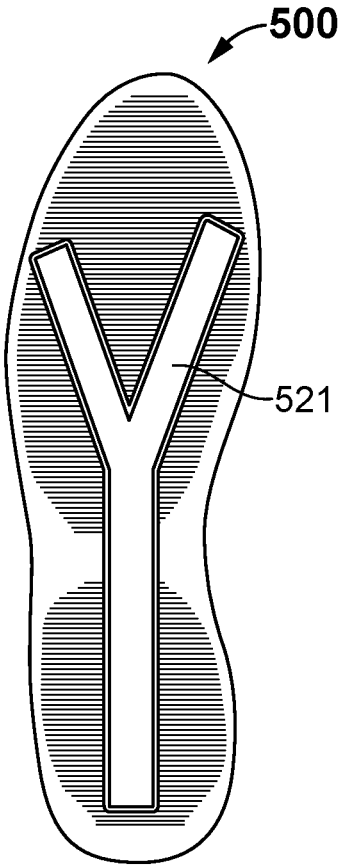
FIG. 13A depicts a bottom view of the shoe illustrating the Y-shape design with the Y-shape protruding.
Figure 13B:
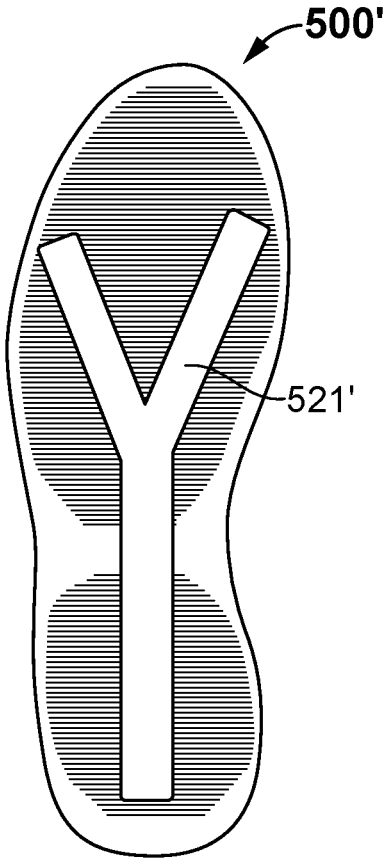
FIG. 13B depicts a bottom view of the shoe illustrating the Y-shape design with the Y-shape having structural fortifications.
Figure 13C:
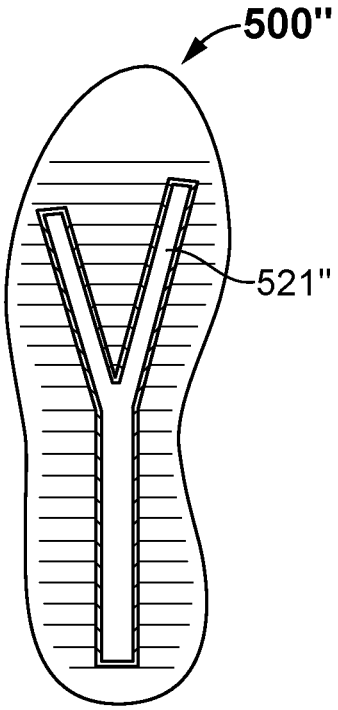
FIG. 13C depicts a bottom view of the shoe illustrating the Y-shape design with the Y-shape hollowed out.

FIGS. 13A-13C provide shoes having generally Y-shaped support structures where the extensions of the Y-shape terminate at or adjacent to the tripod points. FIG. 13A depicts a shoe 500 having a protruding generally Y-shaped support structure 521. FIG. 13B depicts a shoe 500' having a structurally fortified generally Y-shaped support structure 521'. FIG. 13C depicts a shoe 500" having a recessed generally Y-shaped support structure 521".

The embodiments of the present invention, as seen in FIGS. 6, 7, 11A, 11B, 12A, 12B, 13A, 13B, and 13C, provide a shoe with both: (1) energy absorbing elements at the tripod points (the heel or heel area, the ball of the foot or first metatarsal area, and the fifth metatarsal area); and (2) support structure between energy absorbing elements. In FIGS. 6 and 7, the support elements include the bridges 132, 132', 132" which are connected to the energy absorbing elements. However, the present invention does not require connecting bridges 132, 132', 132" nor does the support have to run the full length of the space between the absorbing elements. Further, the design may not require additional structure between each absorbing element (i.e., there may not need to be a bridge or other support structure between the first metatarsal absorbing element and the fifth metatarsal absorbing element). The support structure could be integrated into the design of the sole of the shoe. The support structure could be provided through the use of stiffer materials, additional layers of materials in the sole, or could use thinner, thicker, flexible, stiffer, or stronger bridge 132, 132', 132" in the space between the absorbing elements to provide more support or less support to the mid foot area and to support the dome of the foot or enhance the space for the dome to perform its natural recoil functions. Such additional support aids the foot during impact to prevent or limit the dome from flattening out or to increase and expand the dome's natural coil and recoil ability.

More particularly, the structures and/or the materials used in the running shoe sole, specifically at or right around, or in connecting bridges between, the three tripod strike points, and/or at or right around the tripod triangle, differ from structures and/or materials used in the rest of the sole.

Figure 14:
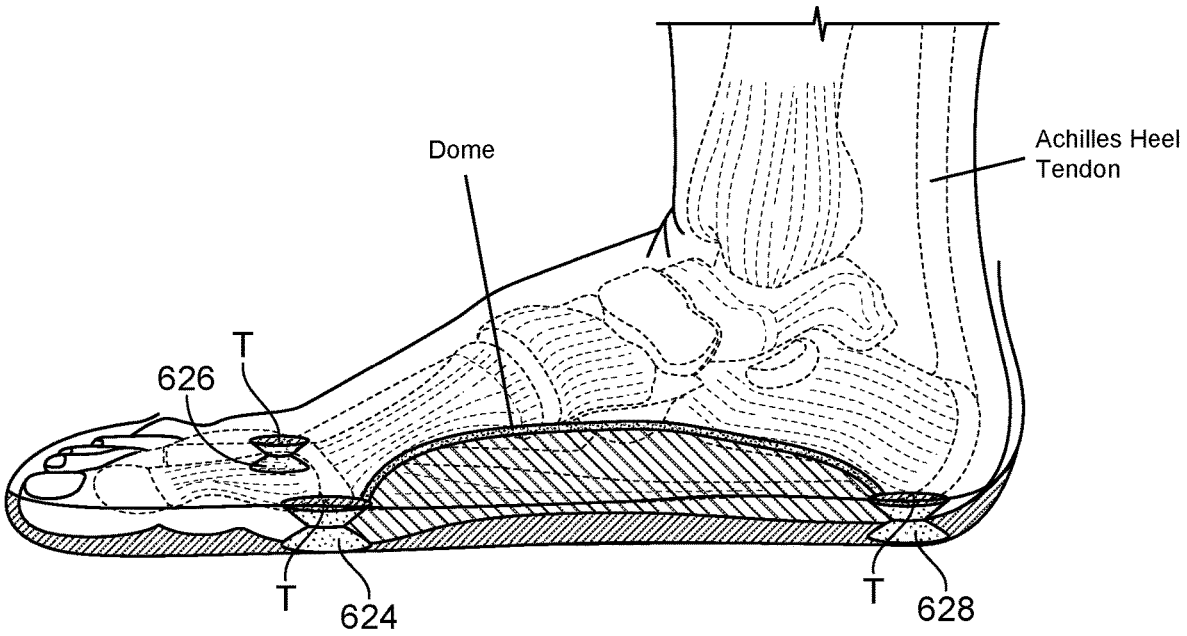
FIG. 14 depicts a side elevation of the foot in combination with the sole of the shoe where the sole has the tripod spring type reinforcement element of the present invention.

FIG. 14 provides a diagram of this concept of increasing the foot's dome's vertical deformation space (see also FIG. 1) provided to the foot's dome. Here, the three-tripod strike points T are supported by separate unconnected support or cushioning elements 624, 626, 628, while omitting or utilizing less absorption material within and under the tripod triangle and/or inner tripod and below the foot's dome. The absence of absorption material under the tripod triangle provides additional vertical space for the dome and other ligamentous and/or bony structures of the foot, to deform and reform, which, in turn, allows for increased 'coiling' and 'uncoiling' of the dome. Thus, during gait, the buildup and release of the foot's natural elastic energy is increased, leading to enhanced elastic power flow and improved biomechanical performance of the user. In addition, the targeted absorption or bounce creating elements help to extend the size or length of the three tripod points (heel, first metatarsal, fifth metatarsal), as well as the power of the tripod and dome. This extension or size expansion of the tripod points by the targeted absorption or bounce creating elements keeps the tripod points at an elevated height (as compared to the foot on a flat surface) which provides more vertical dome deformation space as well as extends the distance between the tripod points due to the load and flattening of the foot under load. This extension of size expansion increases the dome deformation space which results in increased potential build-up of elastic energy from a larger or increased coiling and uncoiling of the foot's dome.

As seen in the Figures, the design, structures, systems, and techniques used in the one or more embodiments of the present invention are employed in the running shoe in general, and the running shoe sole, insole, in-lay, insert, or any subportion thereof, to support the three tripod strike points and/or the tripod triangle. The elements include, but are not limited to, the placement in the sole of supporting and enhancing structures and/or materials at and/or right around, or in connecting bridges between, the three tripod strike points and/or at, or right around, the tripod triangle of each foot.

The present invention's physical structure used in the running shoe sole, insole, in-lay, insert, or any subportion thereof, at and/or right around the three tripod strike points and/or at, or right around, the tripod triangle in the sole of the running shoe can include, but are not limited to, a protrusion, a depression, a shaft, a tube, a prism, or materials that differ from, but run flush with, the surrounding sole.

The present invention's supporting materials used in the running shoe in general, and the running shoe sole, insole, in-lay, insert, or any subportion thereof, at and/or right around the three tripod strike points and/or at, or right around, the tripod triangle in the sole can be natural, artificial and/or natural-artificial hybrid substances, including, but not limited to, air, water, chemicals, silicone, rubber, gels, and/or plastics. By focusing on the three tripod strike points and/or the tripod triangle this invention allows for running shoes to be relatively light and sleek.

Addition Implementations

The present invention's implementation possibilities include, but are not limited to: (1) an added structure at each of the three tripod strike points only, in the form of some kind of protrusion on the sole (as seen in FIGS. 10A) and/or the in-lay of the shoe; (2) added structure at each of the three tripod points where the three tripod points are fortified but more or less a flush structure in the sole (as seen in FIG. 10B) and/or the in-lay of the shoe; and/or (3) added structure at the three tripod points where the three tripod points have a hollowing out of the sole (as seen in FIG. 10C) and/or the in-lay of the shoe; and/or (4) a triangle-like shape at or right next to the tripod triangle of the foot, with some kind of protrusion on the sole (as seen in FIG. 11A) and/or the in-lay of the shoe; (5) a triangle-like shape at or right next to the tripod triangle of the foot with the triangle having a fortified but more or less flush structure in the sole (as seen in FIG. 11B) and/or the in-lay of the shoe, and/or (6) a triangle-like shape at or right next to the tripod triangle of the foot with a hollowing out of one or more portions of the tripod points or triangle (as seen in FIG. 12A) or the entire triangle (as seen in FIG. 12B) and/or the in-lay of the shoe, and/or (7) a Y-shape between the three tripod strike points, in the form of some kind of protrusion on the sole (as seen in FIG. 13A) and/or the in-lay of the shoe; (8) a Y-shape between the three tripod strike points with elements of the Y-shape fortified but more or less flush structure in the sole (as seen in FIG. 13B) and/or the in-lay of the shoe; and/or (9) a Y-shape between the three tripod strike points with all or a portion of the Y-shape elements having a hollowing out of the sole (as seen in FIG. 13C) and/or the in-lay of the shoe Examples of Use Amateur runners who are converting to a mid-foot landing run but experience transition problems.

Any runner who wants to run faster and limit their injury exposure.

Pro-runners who want to optimize their technique and, for instance, maximize their air time during the run without using relatively heavy or relative clunky running shoes.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An article of footwear comprising:

an upper;

a sole having a triangular shaped sole insert, wherein the triangular shaped sole insert includes:

a heel tripod strike point enhancing, impact absorbing and recoil element;

a first metatarsal tripod strike point enhancing, impact absorbing and recoil element;

a fifth metatarsal tripod strike point enhancing, impact absorbing and recoil element;

a first bridge connecting the heel tripod strike point enhancing, impact absorbing and recoil element to the first metatarsal tripod strike point enhancing, impact absorbing and recoil element;

a second bridge connecting the heel tripod strike point enhancing, impact absorbing and recoil element to the fifth metatarsal tripod strike point enhancing, impact absorbing and recoil element;

a third bridge connecting the first metatarsal tripod strike point enhancing, impact absorbing and recoil element to the fifth metatarsal tripod strike point enhancing, impact absorbing and recoil element; and wherein the first bridge, second bridge, and third bridge each have a concave dome shape.

2. The article of footwear of claim 1, wherein the heel tripod strike point enhancing, impact absorbing and recoil element, the first metatarsal tripod strike point enhancing, impact absorbing and recoil element, and the fifth metatarsal tripod strike point enhancing, impact absorbing and recoil element are a polymer material with a spring shape.

3. The article of footwear of claim 1, wherein the heel tripod strike point enhancing, impact absorbing and recoil element, the first metatarsal tripod strike point enhancing, impact absorbing and recoil element, and the fifth metatarsal tripod strike point enhancing, impact absorbing and recoil element are a polymer material with a concave cup shape.

4. The article of footwear of claim 1, wherein the heel tripod strike point enhancing, impact absorbing and recoil element, the first metatarsal tripod strike point enhancing, impact absorbing and recoil element, and the fifth metatarsal tripod strike point enhancing, impact absorbing and recoil element each comprise a plurality of sphere-shaped absorbing elements.

5. The article of footwear of claim 1, wherein the triangular shaped sole insert has an inner triangular void between the first bridge, second bridge and third bridge.

6. The article of footwear of claim 1, wherein the triangular shaped sole insert extends when under compression.

7. The article of footwear of claim 1, wherein the first bridge, second bridge, and third bridge extend under compression creating an expanded triangular shape.

8. A sole insert structure for an article of footwear, the sole insert structure comprising:

a heel impact absorbing and recoil element;

a first metatarsal impact absorbing and recoil element;

a fifth metatarsal impact absorbing and recoil element;

a first bridge connecting the heel impact absorbing and recoil element to the first metatarsal impact absorbing and recoil element;

a second bridge connecting the heel impact absorbing and recoil element to the fifth metatarsal impact absorbing and recoil element;

a third bridge connecting the first metatarsal second impact absorbing and recoil element to the fifth metatarsal impact absorbing and recoil element; and wherein the first bridge, second bridge, and third bridge each have a concave dome shape.

9. The sole insert of claim 8, wherein the heel impact absorbing and recoil element, the first metatarsal impact absorbing and recoil element, and the fifth metatarsal impact absorbing and recoil element are a polymer material with a spring shape.

10. The sole insert of claim 8, wherein the heel impact absorbing and recoil element, the first metatarsal impact absorbing and recoil element, and the fifth metatarsal impact absorbing and recoil element are a polymer material with a concave dome shape.

11. The article of footwear of claim 8, wherein the heel impact absorbing and recoil element, the first metatarsal impact absorbing and recoil element, and the fifth metatarsal impact absorbing and recoil element each comprise a plurality of sphere-shaped impact absorbing and recoil elements.

12. The sole insert of claim 8, wherein the first bridge, second bridge, and third bridge form a triangular shape.

13. The sole insert of claim 12, wherein the triangular shaped sole insert forms an inner triangular void.

14. The sole insert of claim 12, wherein the triangular shaped sole insert extends when under compression.

15. The sole insert of claim 12, wherein the first bridge, second bridge, and third bridge extend under compression creating an expanded triangular shape.

16. An article of footwear comprising:

an upper;

a sole having a triangular shaped sole insert, wherein the triangular shaped sole insert includes:

a heel tripod strike point enhancing, impact absorbing and recoil element;

a first metatarsal tripod strike point enhancing, impact absorbing and recoil element;

a fifth metatarsal tripod strike point enhancing, impact absorbing and recoil element;

a first bridge having a concave dome shape connecting the heel tripod strike point enhancing, impact absorbing and recoil element to the first metatarsal tripod strike point enhancing, impact absorbing and recoil element;

a second bridge having a concave dome shape connecting the heel tripod strike point enhancing, impact absorbing and recoil element to the fifth metatarsal tripod strike point enhancing, impact absorbing and recoil element;

a third bridge having a concave dome shape connecting the first metatarsal tripod strike point enhancing, impact absorbing and recoil element to the fifth metatarsal tripod strike point enhancing, impact absorbing and recoil element;

wherein the heel tripod strike point enhancing, impact absorbing and recoil element, the first metatarsal tripod strike point enhancing, impact absorbing and recoil element, and the fifth metatarsal tripod strike point enhancing, impact absorbing and recoil element are a polymer material with a spring shape;

wherein the triangular shaped sole insert has an inner triangular void between the first bridge, the second bridge and third bridge; and wherein the first bridge, the second bridge, and third bridge extend under compression creating an expanded triangular shape.

* * * * *